US005391314A

United States Patent [19]

Minemura et al.

[11] Patent Number: 5,391,314

[45] Date of Patent: Feb. 21, 1995

[54] ELECTROVISCOUS FLUID COMPOSITION COMPRISING A SILICONE OIL, SYNTHETIC FLUORINATED OIL AND AN ADDITION POLYMER

[75] Inventors: Masahiko Minemura; Satoshi Kuwata, both of Gunma, Japan

[73] Assignee: Shin-Etsu Chemical Co., Ltd., Tokyo, Japan

[21] Appl. No.: 115,809

[22] Filed: Sep. 3, 1993

Related U.S. Application Data

[63] Continuation of Ser. No. 701,723, May 17, 1991, abandoned.

[30] Foreign Application Priority Data

May 18, 1990 [JP] Japan ..... 2-128887

[51] Int. Cl.[6] ..... C10M 169/04; C10M 171/00

[52] U.S. Cl. ..... 252/78.3; 252/73; 252/79; 252/572; 252/573

[58] Field of Search ..... 252/73, 78.3, 78.1, 252/79, 572, 573

[56] References Cited

U.S. PATENT DOCUMENTS 4,129,513 12/1978 Stangroom ..... 252/78.1
4,556,511 12/1985 Nishigaki et al. ..... 252/573
4,812,251 3/1989 Stangroom ..... 252/75

FOREIGN PATENT DOCUMENTS 2-142896 5/1990 Japan .

*Primary Examiner*—Christine Skane

*Attorney, Agent, or Firm*—Millen, White, Zelano, & Branigan

[57] ABSTRACT

An electroviscous fluid composition comprising a dispersion medium of two nonmiscible components (A) and (B) as below, the volum ratio of (A)/(B) being in the ratio 99/1-1/99, and a dispersoid (C) as below; wherein the true specific gravity of the dispersoid (C) is greater than the specific gravity of said component (A) and less than the specific gravity of said component (B);

Component (A):

A silicone oil of general formula (I):

$$R_aSiO_{(4-a)/2}$$

(wherein R, which may be similar or dissimilar, are monovalent hydrocarbon groups with 1-18 carbon atoms and "a" lies in the range $1.8<a<3.0$.) having a viscosity of 1-1,000 centistokes at 25° C. and a specific gravity of 0.8-1.5, Component (B):

A synthetic fluorinated oil having a viscosity of 1-1,000 centistokes at 25° C. and a specific gravity greater than 1.4, Component (C):

An addition polymer obtained by polymerizing a main component consisting of at least one type of monomer chosen from acrylic acid and its esters or metal salts, and methacrylic acid and its esters or metal salts; is disclosed. In this composition, there is far less sedimentation of dispersoid in comparison to conventional electroviscous fluid compositions.

11 Claims, No Drawings

ELECTROVISCOUS FLUID COMPOSITION COMPRISING A SILICONE OIL, SYNTHETIC FLUORINATED OIL AND AN ADDITION POLYMER

This application is a continuation, of application Ser. No. 07/701,723, filed May 17, 1991, now abandoned.

FIELD OF THE INVENTION

This invention concerns electroviscous fluid compositions, and in particular, an electroviscous fluid composition with excellent heat resistance, cold resistance and storage stability.

BACKGROUND OF THE INVENTION

Electroviscous fluids are fluids which change their viscosity when a voltage is applied to them. This property is used, for example, in mechanically moving control parts such as automobile clutches, brakes and engine mountings. Examples of such fluids which have been studied in the prior art are compositions wherein starch, silica gel and polyacrylates are dispersed in a non-conducting medium. The specific gravity of the dispersoid was however high compared to that of the dispersion medium, and it therefore tended to settle out to form a sediment. Other compositions have been reported wherein sedimentation is avoided by changing the type of solid component or increasing its blending proportion, but these are better described as pastes rather than fluids. In U.S. Pat. Nos. 4,033,892, 4,129,513 and Japanese patent Kokoku (Examined Japanese Patent Publication) No. 26, 151/'88, a composition is disclosed consisting mainly of an acrylic polymer as a dispersoid; in British Patent No. 1,076,754 and Japanese Patent Kokai (Unexamined Japanese Patent Publication) Nos. 259,752/'86 and 44,998/'86, a composition is disclosed consisting of a silica or silica gel dispersoid; in Japanese Patent Kokai No. 95,397/'87, a composition is disclosed consisting of an aluminium silicate dispersoid; in British Patent No. 3, 047,507 and Japanese Patent Kokai No. 32,197/'83, a composition is disclosed consisting mainly of a barium titanate dispersoid; and in Japanese Patent Kokai No. 33,459/'88, a composition is disclosed consisting of a polyacrylamide dispersion. Of these compositions, those wherein the dispersoid is an acrylic polymer have an excellent electrical field response, and are also known to perform very well in mechanically moving control parts. However, these dispersoids have a high true specific gravity of 1.3–1.6. They therefore suffered from the disadvantage that they settled out with time, and it was consequently difficult to obtain compositions which were stable over long periods. One method proposed to overcome this defect was to use a substance of high specific gravity, for example trifluorovinyl chloride polymer, polychlorinated biphenyl or orthodichlorobenzene, as the dispersion medium.

These dispersion media were however harmful to persons or the environment, and some of them had relatively high volatility. They were therefore not necessarily suitable.

Further, in Japanese Patent Kokai 275699/'89, a method is proposed wherein a dye is dispersed in a mixture of a silicone oil and a fluorinated oil of similar specific gravity to make a suspension.

In this case, to improve the storage stability of the dispersoid, very strict quality control is necessary to ensure that the specific gravity of the dispersion medium is the same as that of the dispersoid, the dye. This presented a problem in manufacture.

Further, various dispersion stabilizers have been proposed to control the above sedimentation (Japanese Patent Kokai 44,998/'86 and 95,397/'87), but the addition of these substances also caused a decline in the electrical insulating properties of the composition. The inventors of the present invention, after detailed studies, found that by dispersing a powder of an addition polymer derived mainly from an acrylate or methacrylate monomer in a 2 phase fluid consisting of a mixture of a silicone oil and a synthetic fluorinated oil, sedimentation of the dispersoid could easily be prevented, and a long-life electroviscous fluid composition could be obtained.

SUMMARY OF THE INVENTION

A first object of this invention is therefore to provide a long-life electroviscous fluid composition wherein sedimentation of the dispersoid does not occur.

A second object of this invention is to provide a method to prevent sedimentation of the dispersoid in electroviscous fluid compositions.

The above objects are attained by an electroviscous fluid composition comprising a dispersion medium of two non-miscible components (A) and (B) as below, the volume ratio of (A)/(B) being in the ratio 99/1–1/99, and a dispersoid (C) as below. This composition is characterized by the fact that the true specific gravity of the dispersoid is greater than the specific gravity of said component (A) and less than the specific gravity of said component (B).

Component (A):

A silicone oil of general formula (I):

$$R_aSiO_{(4-a)/2}$$

(wherein R, which may be similar or dissimilar, are monovalent hydrocarbon groups with 1–18 carbon atoms and "a" lies in the range $1.8<a<3.0$.) having a viscosity of 1–1,000 centistokes at 25° C. and a specific gravity of 0.8–1.5.

Component (B):

A synthetic fluorinated oil having a viscosity of 1–1,000 centistokes at 25° C. and a specific gravity greater than 1.4.

Component (C):

An addition polymer obtained by polymerizing a main component consisting of at least one type of monomer chosen from acrylic acid and its esters or metal salts, and methacrylic acid and its esters or metal salts.

The electroviscous fluid composition of this invention has excellent electroviscosity, and due to the fact that there is far less sedimentation of dispersoid in comparison to electroviscous fluid compositions of the prior art, it also has excellent storage stability.

DETAILED DESCRIPTION OF THE INVENTION

The silicone oil (A) represented by general formula (I): $R_aSiO_{(4-a)/2}$; may be a linear, branched or cyclic compound. The substituent groups R may be similar or dissimilar. R are monovalent hydrocarbon groups with 1–18 carbon atoms, and are chosen from alkyl groups such as methyl, ethyl and propyl; cycloalkyl groups such as cyclohexyl; phenyl groups; or per-fluoroalkyl groups such as 3,3,3-trifluoropropyl, 3,3,4,4,5,5,6,6,6,-nonafluorohexyl, and 3,3,4,4,5,5,6,6,7,7,8,8,9,9,10,10,10-heptadecafluorodecyl. It is moreover preferable that from 5% to 50% of the substituent group R is a saturated fluoroalkyl, and in particular desirable that said saturated fluoroalkyl is trifluoropropyl.

In general formula (I), "a" lies in the range $1.8<a<3.0$.

The viscosity and specific gravity of the silicone oil may thus be varied by suitably choosing R and a, but in view of the relationship with the dispersoid (C), it is desirable that its specific gravity is 0.8–1.5. Further, the viscosity should preferably be 1–1,000 at 25° C.

The synthetic fluorinated oil (B), from the viewpoints of high temperature storage stability and particle dispersibility, should preferably have a viscosity of 1–1,000 centistokes at 25° C. and its specific gravity should be greater than that of the true specific gravity of the dispersed particles. In addition, it must have a low volatility, and it should therefore have a specific gravity greater than 1.4. Commercial products which may be used as component (B) are Demnum S-0, S-20, S-65, S-100 and S-200 (Trde names:Manufactured by Daikin Industries Co. LTD. The products designated Demnum are perfluoropolyether oils having specific gravity in the range of 1.840–1.890 (at 25° C.) and a chemical structure of

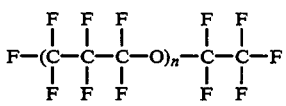

wherein n is an integer greater than 1, and is an average of:

| commercial name | average n |
|---|---|
| S-20 | 14 |
| S-65 | 26 |
| S-100 | 33 |
| S-200 | 50 |

Component (C) may be an addition polymer consisting only of at least one type of monomer chosen from acrylic acid, methacrylic acid and their esters or metal salts. It may however also contain an olefin, maleic anhydride, vinyl chloride, vinyl acetate or N-vinylpyrrolidone, or it can be crosslinked by a crosslinking diolefin such as divinylbenzene, diallyl ether or N,N'-dimethylene-bis-acrylamide.

The particle diameter of the powder of component (C) may conveniently be 1–50 μm, but it is more preferably 10–30 μm. If the particle diameter is less than 1 μm, satisfactory electroviscosity (increase of viscosity) is not obtained. If on the other hand it is greater than 50 μm, sedimentation of polymer powder tends to increase, and stable performance is not obtained over a long period.

Commercial products which may be used as component (C) include for example water absorbing polymers such as Sanwet IM-300MPS, Sanwet IM-1,000 MPS, Sanwet IM-5,000 MPS (Trade Names: Manufactured by SANYO CHEMICAL INDUSTRIES. LTD.); Sumikagel SP-510, Sumikagel NP-1010 (Trade Names: Manufactured by Sumitomo Kagaku Kogyo K.K.); and AQUALIC CA (Trade Name: Manufactured by NIPPON SHOKUBAI KAGAKU KOGYO CO. LTD.).

The electroviscous fluid composition of this invention uses a 2 phase fluid mixture of a silicone oil and a synthetic fluorinated oil as the dispersion medium. Compared to the trifluorovinyl chloride monomer, polychlorinated biphenyl, orthodichlorobenzene, dibutylphthalate and trimellitic acid esters which were used in the prior art, therefore, it has excellent stability, low volatility, heat resistance and cold resistance. In addition, it has little viscosity-temperature variation, and has stable properties as a working fluid.

Further, as the specific gravity of the synthetic fluorinated oil is greater than that of the dispersoid, the dispersoid does not collect at the bottom of the containing vessel, and the dispersion always retains its fluidity.

EXAMPLES

We shall now describe this invention in more detail by examples but the invention is in no way limited to them.

Example 1

25 g of sodium polyacrylate powder, Sanwet IM-5,000 MPS (Sanyo Kasei Kogyo K.K.), was added to a 2 phase mixture (volume ratio=86/14) of 80 g of dimethylsiloxane-methyl (3,3,3-trifluoropropyl) siloxane copolymer terminated at both ends with trimethylsiloxy groups (viscosity at 25° C.: 50 centistokes, specific gravity: 1.13), and 20 g of Demnum S-20 (Trade Name: Manufactured by DAIKIN INDUSTRIES, LTD., specific gravity: 1.8), so as to give a white liquid. After leaving this liquid at room temperature for one day, it was observed that the dispersoid had sedimented out up to approx. 85% of the height of the liquid surface, and after 10 days to approx. 80% of the height of the liquid surface. This amount of sedimentation, however, was not so serious that it caused any problem in actual use.

The electroviscosity of the white liquid obtained was measured at room temperature by a Contraves rotating viscosimeter (Trade Name: Rhcomat 115) and a Codix Voltage Controller, using a rotor speed of 10 rpm and a rotor clearance of 1 mm. The viscosity showed excellent values of 3,000 cp, 90,000 cp and 200,000 cp at applied voltages of 0 kv/mm, 2 Kv/mm and 3.5 kv/mm respectively.

Example 2

A 2 phase liquid (volume ratio=61/39) was obtained as in Example 1, except that 50 g of siloxane copolymer and 50 g of Demnum S-20 were used.

The lower phase of this liquid consisted of Demnum S-20, and the upper phase of said siloxane copolymer and Sanwet IM-5,000 MPS. Even after 10 days, there was no sedimentation into the lower phase, and there were no problems in actual use.

When the electroviscosity of the white liquid obtained was measured as in Example 1, good values were found for the viscosity of 3,000 cp, 90,000 cp and 200,000 cp at each voltage respectively.

Example 3

A white liquid was obtained (volume ratio=87:13) as in Example 1, except that the siloxane copolymer was 3,3,4,4,5,5,6,6,7,7,8,8,9,9,10,10-heptadecafluorodecyl tri(-dimethyldecylsiloxy) silane (viscosity at 25° C. 25 centistokes, specific gravity: 1.10). When this liquid was left at room temperature for one day, it was observed that the dispersoid had sedimented out up to approx. 80% of the height of the liquid surface, and after 10 days to approx. 75% of the height of the liquid surface. As in Example 2, however, there was no problem in actual use. When the electroviscosity of the liquid obtained was measured as in Example 1, good values were found for the viscosity of 3,000 cp, 90,000 cp and 200,000 cp at each voltage respectively.

Comparative Example 1

A white liquid was obtained by mixing 25 g of Sanwet IM-5,000 MPS with 100 g of the siloxane copolymer used in Example 1.

When this liquid was left at room temperature for one day, it was observed that the dispersoid had sedimented out up to approx. 80% of the height of the liquid surface, and after 10 days to approx. 75% of this height. Unlike Example 1, however, Sanwet IM-5,000 MPS adhered to the bottom of the container, and the fluidity of the liquid deteriorated.

When the electroviscosity of the white liquid obtained was measured as in Example 1, the viscosity was found to be 3,000 cp, 6,000 cp and 150,000 cp at each voltage respectively. These values are poorer than those of the above examples.

Comparative Example 2

A 2 phase liquid was obtained as in Comparative Example 1 except that instead of the siloxane copolymer, an equivalent amount of Demnam S-20 was used. In this case, Sanwet IM-5,000 MPS formed a hard layer on the liquid surface, and this had poor dispersibility. When the electroviscosity of the 2 phase liquid obtained was measured as in Example 1, the viscosity was found to be 2,000 cp, 3,000 cp and 5,000 cp at each voltage respectively. These values are poorer than those of the above examples.

What is claimed is:

1. An electroviscous fluid composition comprising a dispersion medium of two non-miscible components (A) and (B) as below, the volume ration of (A)/(B) being in the ratio 99/1–1/99, and a dispersoid (C) as below, wherein the true specific gravity of the dispersoid (C) is greater than the specific gravity of said component (A) and less than specific gravity of said component (B);

Component (A):

A silicone oil of general formula (I):

$$R_aSiO_{(4-a)/2}$$

wherein each R, independently is a monovalent hydrocarbon group with 1–18 carbon atoms and "a" lies in the range $1.8<a<3.0$, having a viscosity of 1–1,000 centistokes at 25° C. and a specific gravity of 0.8–1.5, Component (B):

A perfluoropolyether synthetic fluorinated oil having a viscosity of 1–1,000 centistokes at 25° C. and a specific gravity greater than 1.4, Component (C):

An addition polymer obtained by polymerizing at least one monomer selected from the group consisting of acrylic acid an ester or a metal salt of provided for one of ordinary skill in the art to select component (B), a synthetic fluorinated oil. The Office Action further argues that the selection of a specific synthetic fluorinated oil having the recited viscosity, specific gravity and non-miscibility with component (A) would require undue experimentation. This is clearly incorrect.

2. The electroviscous fluid composition of claim 1, wherein 5 mol %–50 mol % of the substituent groups R in component (A) is a saturated fluoroalkyl.

3. The electroviscous fluid composition of claim 2, wherein the saturated fluoroalkyl is trifluoropropyl.

4. The electroviscous fluid composition of claim 1, wherein the particle diameter of the dispersoid of component (C) is 1–50 μm.

5. The electroviscous fluid composition of claim 4, wherein said particle diameter is 10–30 μm.

6. The electroviscous fluid composition of claim 1, wherein the component (C) is a copolymer obtained by the copolymerization reaction of a monomer selected from the group consisting of acrylic acid, methacrylic acid and an ester or metal salt thereof, with a monomer which is selected from the group consisting of an olefin-maleic anhydride, vinyl chloride, vinyl acetate and N-vinylpyrrolidone.

7. The electroviscous fluid composition of claim 1, wherein the component (C) is a polymer crosslinked by a crosslinking diolefin.

8. The electroviscous fluid composition of claim 7, wherein said diolefin is divinylbenzene, diallyl ether or N,N'-dimethylene-bis-acrylamide.

9. The electroviscous fluid composition of claim 6, wherein the component (C) is a polymer crosslinked by a crosslinking diolefin.

10. The electroviscous fluid composition of claim 9, wherein said diolefin is divinylbenzene, diallyl ether or N,N'-dimethylene-bis-acrylamide.

11. The electroviscous fluid composition of claim 1, wherein the perfluoropolyether synthetic fluorinated oil has the formula

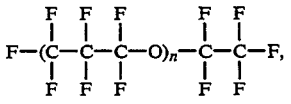

wherein n is 14–50.

* * * * *

UNITED STATES PATENT AND TRADEMARK OFFICE

CERTIFICATE OF CORRECTION

PATENT NO. : 5,391,314

DATED : February 21, 1995

INVENTOR(S) : Masahiko MINEMURA et al.

It is certified that error appears in the above-indentified patent and that said Letters Patent is hereby corrected as shown below:

Claim 1; column 6, line 7: After "metal salt of" insert - - acrylic acid, methacrylic acid, and an ester or metal salt of methacrylic acid - -.

Claim 1; column 6, line 7: Delete "provided for one of ordinary skill in the art to select component (B), a synthetic fluorinated oil. The Office Action further argues that the selection of a specific synthetic fluorinated oil having the recited viscosity, specific gravity and non-miscibility with component (A) would require undue experimentation. This is clearly incorrect."

UNITED STATES PATENT AND TRADEMARK OFFICE

CERTIFICATE OF CORRECTION

PATENT NO. : 5,391,314

DATED : February 21, 1995

INVENTOR(S) : Masahiko Minemura, et al

It is certified that error appears in the above-indentified patent and that said Letters Patent is hereby corrected as shown below:

Claim 6; column 6, line 30: After olefin replace "-" with —,—.

Signed and Sealed this

Twenty-seventh Day of June, 1995

*Attest:*

Bruce Lehman

BRUCE LEHMAN

*Attesting Officer*

*Commissioner of Patents and Trademarks*